US005727367A

United States Patent [19]

Cahill et al.

[11] Patent Number: 5,727,367

[45] Date of Patent: Mar. 17, 1998

[54] PACKING METHOD AND APPARATUS

[75] Inventors: Michael John Cahill; Kevin Richard Fincham, both of Coventry; Geoffrey William Vernon, Bucks, all of Great Britain

[73] Assignee: Molins PLC, Milton Keynes, England

[21] Appl. No.: 636,395

[22] Filed: Apr. 23, 1996

Related U.S. Application Data

[63] Continuation of Ser. No. 322,552, Oct. 13, 1994, abandoned.

[30] Foreign Application Priority Data

Oct. 13, 1993 [GB] United Kingdom ..... 9321148

[51] Int. Cl.[6] ..... B65B 19/20; B65B 19/22

[52] U.S. Cl. ..... 53/462; 53/52; 53/202; 53/208; 53/389.3; 493/459; 493/911

[58] Field of Search ..... 53/462, 207, 208, 53/389.3, 389.2, 504, 500, 498, 65, 76, 75, 52, 77, 202, 140; 493/459, 911, 399

[56] References Cited

U.S. PATENT DOCUMENTS

| | | | |
|---|---|---|---|
| 3,008,280 | 11/1961 | Barkman | 53/208 X |
| 3,589,100 | 6/1971 | Konacs | 53/76 X |
| 4,385,479 | 5/1983 | Focke | 53/389.3 |
| 4,617,780 | 10/1986 | Focke et al. | 53/202 X |
| 4,715,847 | 12/1987 | Focke et al. | 493/11 |
| 4,887,412 | 12/1989 | Takamura | 53/66 X |
| 4,898,569 | 2/1990 | Focke . | |
| 4,952,281 | 8/1990 | Akira | 492/459 X |
| 5,009,749 | 4/1991 | Cederholm et al. | 493/459 X |
| 5,316,811 | 5/1994 | Focke et al. | 493/911 X |

*Primary Examiner*—James F. Coan

*Attorney, Agent, or Firm*—Antonelli, Terry, Stout & Kraus, LLP

[57] ABSTRACT

Packaging material, particularly for forming blanks for hinged lid packets, is delivered to a packaging machine in web form and at least one creasing or shaping operation is performed (44; 112) on the web (2) prior to severing individual blanks (50) from the web. Folding or wrapping of a blank around an article to be packed in the machine is monitored and the creasing or shaping operation varied to optimise machine performance: for example, an adjustable creasing tool can be adjusted to compensate for tool wear. Individual blanks are inspected for longitudinal curl, usually caused by the web having been wound on a reel, and where necessary a correction is applied during feeding of the web, e.g. by adjusting the angle of wrap of the web around a decurling roller (38; 108).

19 Claims, 7 Drawing Sheets

PACKING METHOD AND APPARATUS

Figure 1:
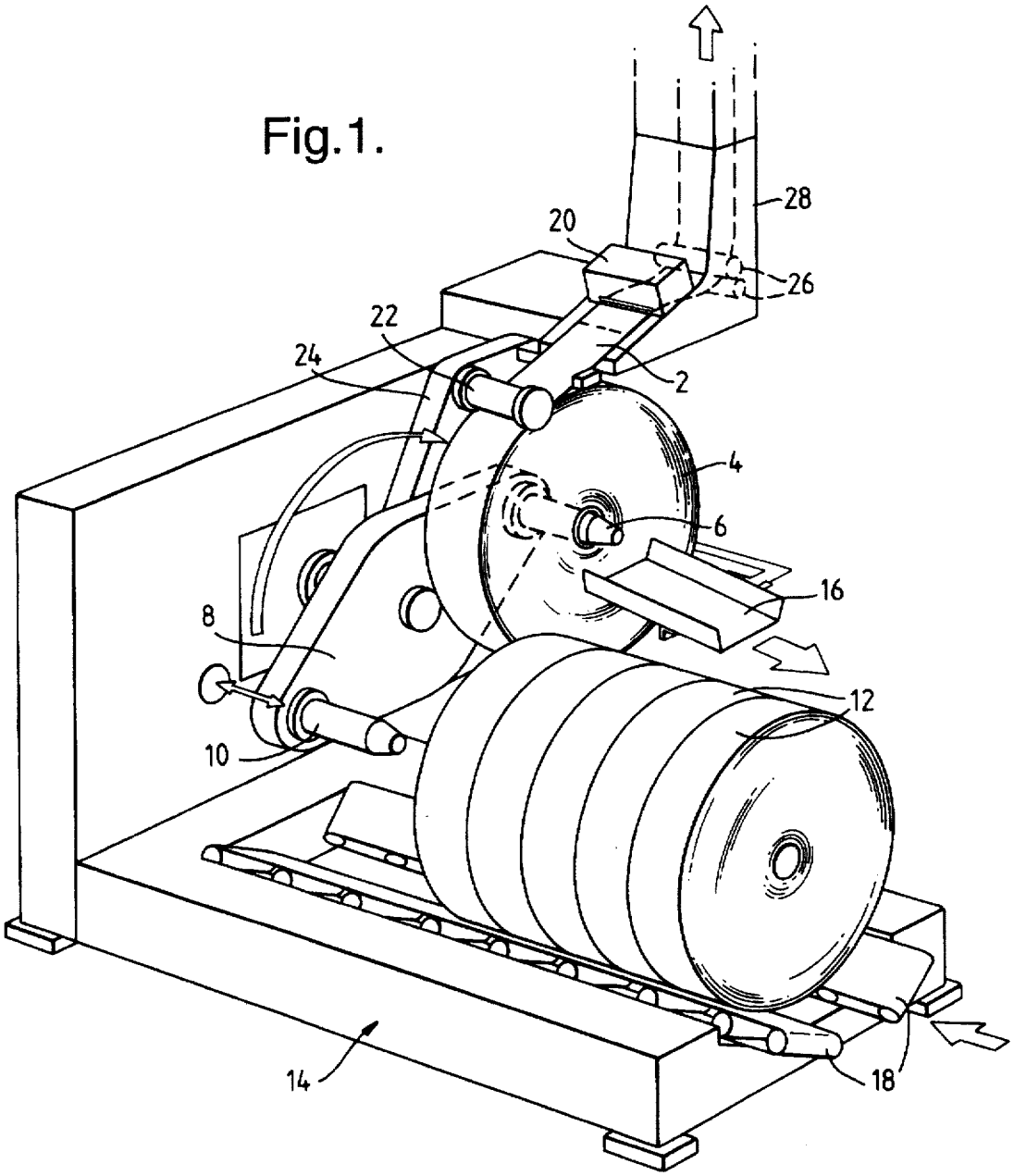

This application is a Continuation of application Ser. No. 08/322,552 filed Oct. 13, 1994, and now abandoned.

This invention relates to a packing method and apparatus, and in particular to production and feeding of package blanks, particularly blanks for use in the manufacture of hinged lid packets such as are commonly used for packing cigarettes.

Where the packaging material used by a machine is relatively thin, e.g. paper, it is common to supply this in web form from reels unwound at the machine. Where thicker material, such as cardboard, is required, e.g. for producing hinged lid packets, it is usual to supply the material as individual blanks, usually in stack form. Such blanks are preprinted, precreased and precut to shape at a location remote from the packing machine, and normally remote from the factory or other premises in which the machine is located. It has been proposed, for example in U.S. Pat. No. 4,898,569, that such thicker material be supplied in web form from a reel. In this proposal the web is preprinted, precreased and substantially precut prior to being wound onto the reel so that successive blanks on the web are separated only by relatively narrow residual connections which are easily broken when the web is unwound and delivered at the packing machine.

According to one aspect of the invention a packing method, particularly for packing articles in hinged lid packets, includes the steps of feeding a web of packaging material, performing at least one creasing or shaping operation on the web, severing packaging blanks (preferably individual blanks) from the web, and delivering said blanks for wrapping or folding around articles to be packed. Preferably the web is delivered from a reel and may be preprinted, but preferably substantially all the necessary creasing and shaping operations required to produce the individual blanks are carried out on the web after it has been unwound from the reel. Preferably the web is moved continuously during the creasing and/or shaping operation or operations. Where the blanks are generally rectangular in shape they may be arranged with their longitudinal axes parallel to or transverse to the longitudinal direction of the web. Particularly where such blanks are arranged with their longitudinal axes parallel to the length of the web, there may be two or more blanks across the width of the web. Having blanks arranged longitudinally on the web also has the advantage that the blanks may be easier to handle after severing from the web, particularly where they are required to be delivered to a modern cigarette packing machine, such as a Molins HLP5, which interfaces more easily with a stream of blanks travelling in a direction parallel to their longitudinal axes.

Apparatus for performing the method may be incorporated at or in a packing machine, i.e. so that reels carrying webs of preprinted but uncreased and/or unshaped packaging material may be delivered to the machine for conversion into fully creased and shaped blanks. Alternatively such apparatus may comprise creasing and/or shaping means at the packing machine, reel handling means remote from the machine, and web conveying means extending from said handling means to the machine. Thus reel handling means for several machines may be located adjacent each other, thereby facilitating reel delivery and releasing space in the vicinity of the machine by removing the reels themselves and the requirement to provide space for reel delivery means.

As compared with reels carrying webs of packaging material in which the creasing and/or shaping of the blanks has already been carried out, reels without (or with fewer of) these features are generally easier to handle as they are less prone to edge damage (because the edges are not shaped) and/or they do not exhibit a tendency for the web to interlock during unwinding (because they do not have shaped sections which tend to interlock) and/or they do not suffer from crease flattening (as can occur as a result of reeling precreased webs under relatively high tension).

According to another aspect of the invention a packing method, particularly for packing articles in hinged lid packets, includes the steps of feeding a web of packaging material from a source, preferably a reel, severing packaging blanks from the web, and subsequently wrapping or folding the blanks around articles to be packed, wherein means is provided for correcting curl in the web or blanks not later than said wrapping or folding step. The method is particularly beneficial for correcting longitudinal curl, i.e. curvature in the web or blank in a direction corresponding to the longitudinal direction of the web, such curl being commonly introduced by the storage of the web on a reel or by passage of the web around a guide such as a roller, particularly where the guide has a small radius. Preferably the correcting means is adjustable, and may be responsive to curl detecting means. Thus optical detecting means may be provided for detecting curl in blanks severed from the web and curl correcting means may be operable on the web in response to the detecting means. Means could be provided for rejecting excessively curled blanks. The correcting means may comprise means defining a curved path for the web, e.g. a roller around which the web is passed, arranged to introduce curl into the web in a sense opposite to that which is detected, i.e. so as to cancel it out. A preferred means for adjusting the amount of curl correction introduced is to increase or decrease the angle of wrap of the web around a relatively small radius roller.

Providing correction for longitudinal curl of packaging blanks, so that only flat blanks are introduced to the wrapping and folding process, is particularly beneficial where the blanks are obtained from a web delivered from a reel, where the process of winding and storing the web in a reel will inevitably introduce longitudinal curl. Feeding blanks which are other than flat into the wrapping and folding process is likely to introduce operational difficulties which will reduce the efficiency of the process.

According to further aspect of the invention a packing method, particularly for packing articles in hinged lid packets, includes the steps of feeding packaging material, preferably in web form, performing at least one creasing or shaping operation on the material, and wrapping and/or folding the packaging material around at least one article to be packed, wherein the performance of the wrapping or folding operation is monitored and the creasing and/or shaping operation is adjusted accordingly to optimise said performance. It is known that some packing machines, particularly high speed machines such as those used for packing cigarettes in hinged lid packets, can be sensitive to relatively minor variations in quality of the packaging material with which they are supplied. For example, variations in extent of precreasing can interfere with efficient operation of a folding operation in the machine. Similarly minor variations in the shape of a cut-out in a packaging material blank can affect efficiency of the machine. Moreover, machines which are otherwise similar may run at their best with slightly different blanks. Generally it has not been possible up to now to accommodate such differences between machines because the blanks were all produced in fully precreased and preshaped form by a remote supplier.

By providing creasing and/or shaping operations which are adaptable in response to machine performance, creasing and/or shaping can be adjusted to optimise machine performance. In a preferred arrangement this is achieved by incorporating adjustable creasing and/or shaping means at the packing machine.

Apparatus for performing the methods of each of the aspects of the invention may be embodied in common apparatus.

Figures 2, 3E, 3F:
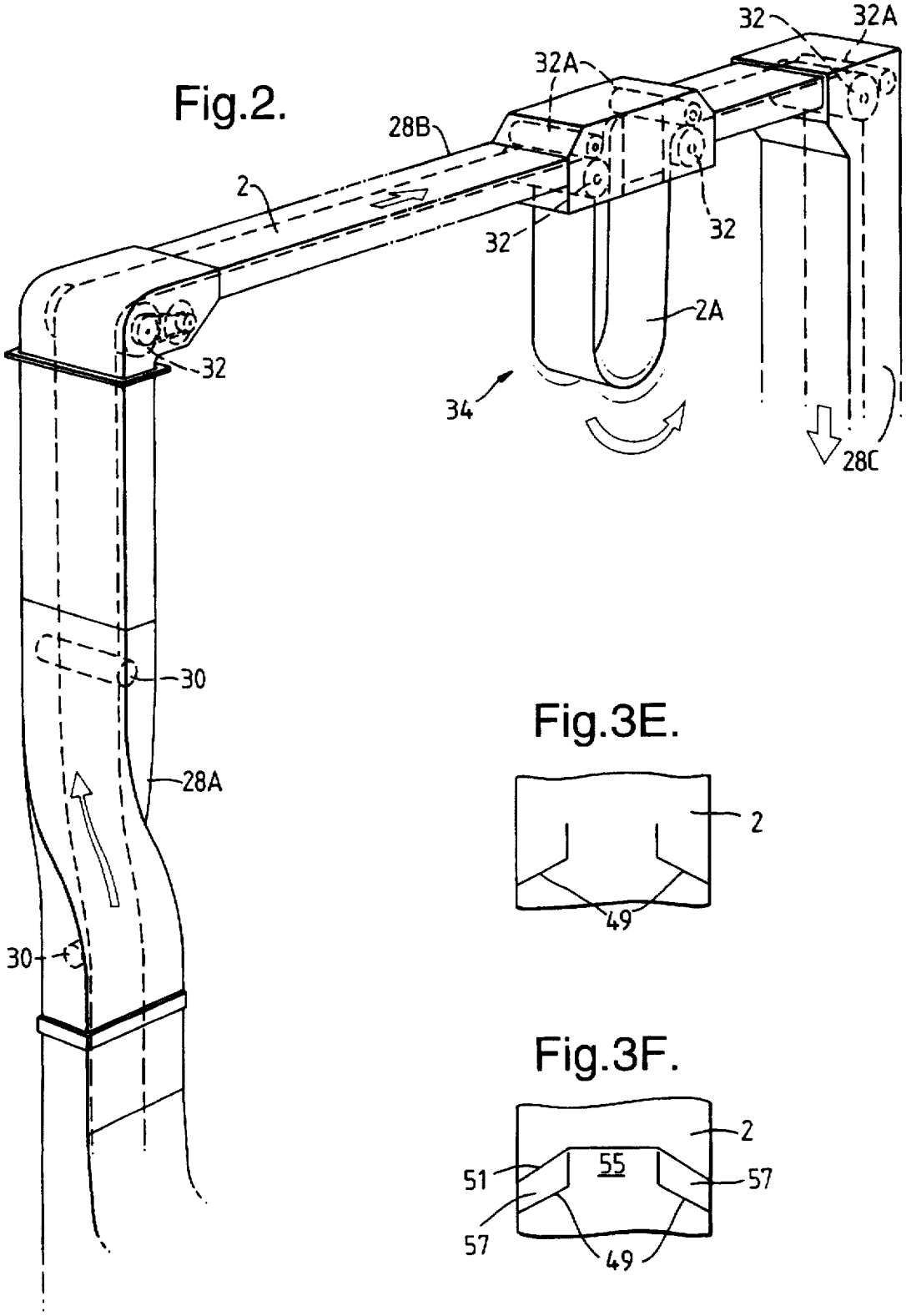
Figures 3, 3A, 3B, 3C, 3D:
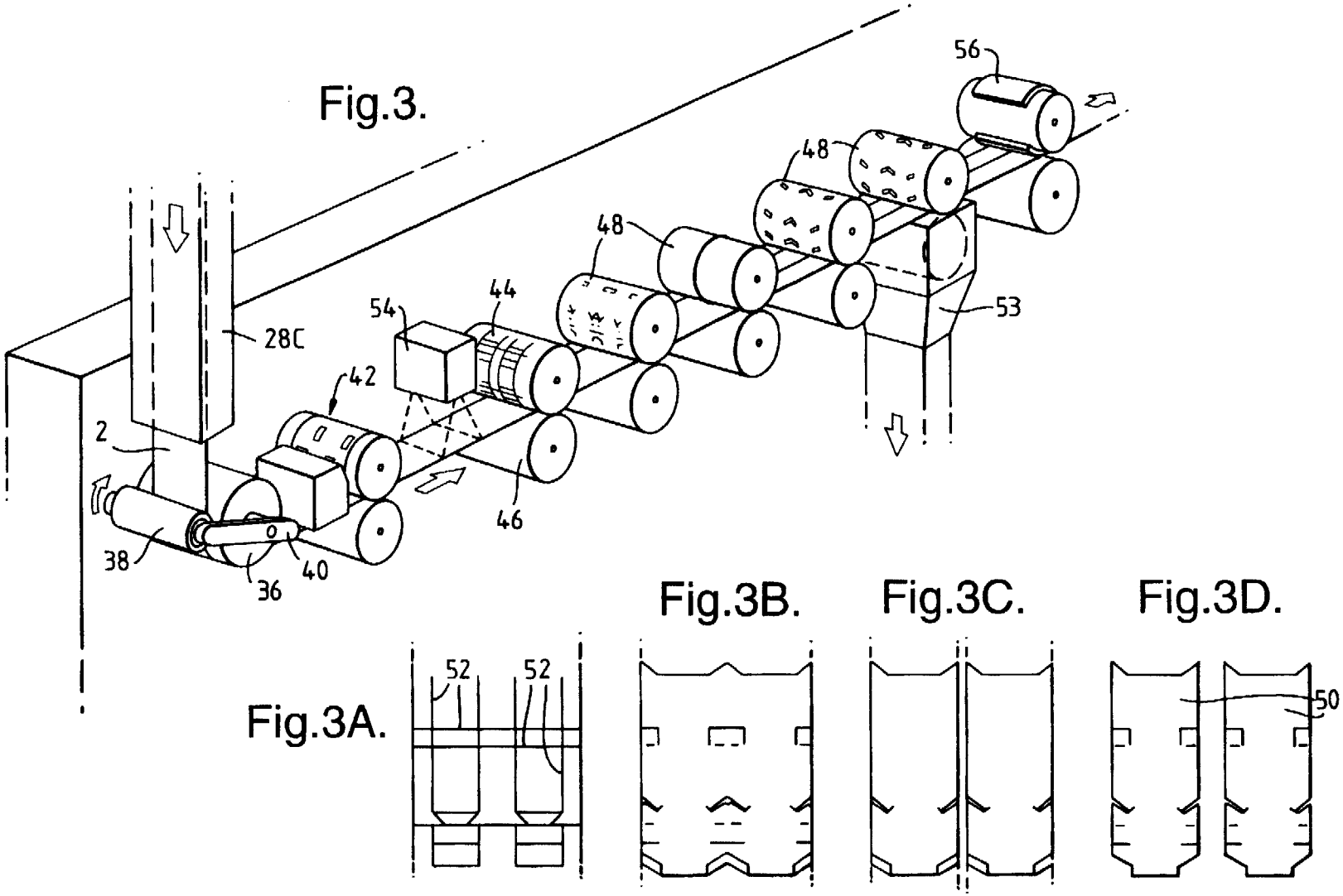
Figure 4:
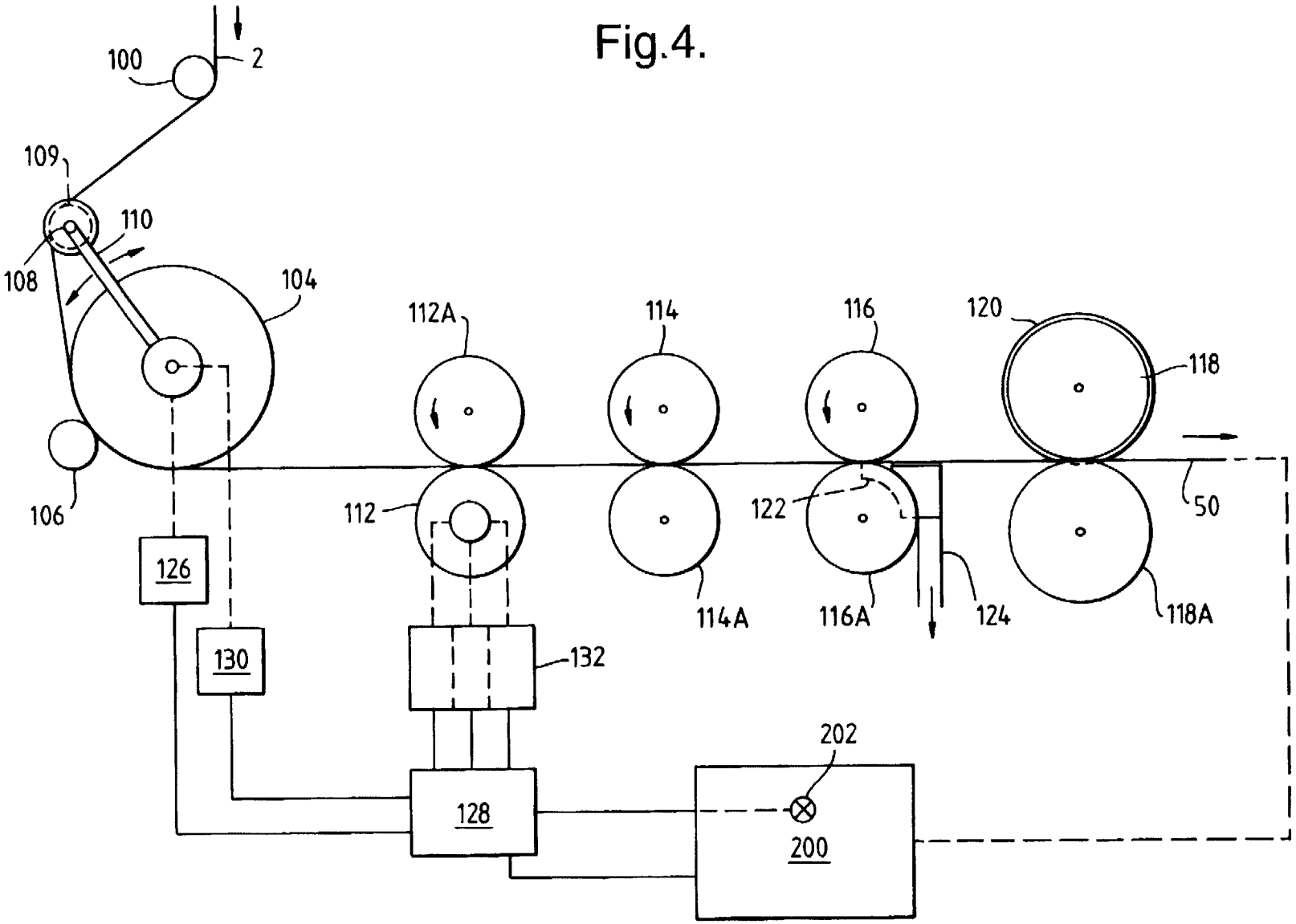
Figure 5:
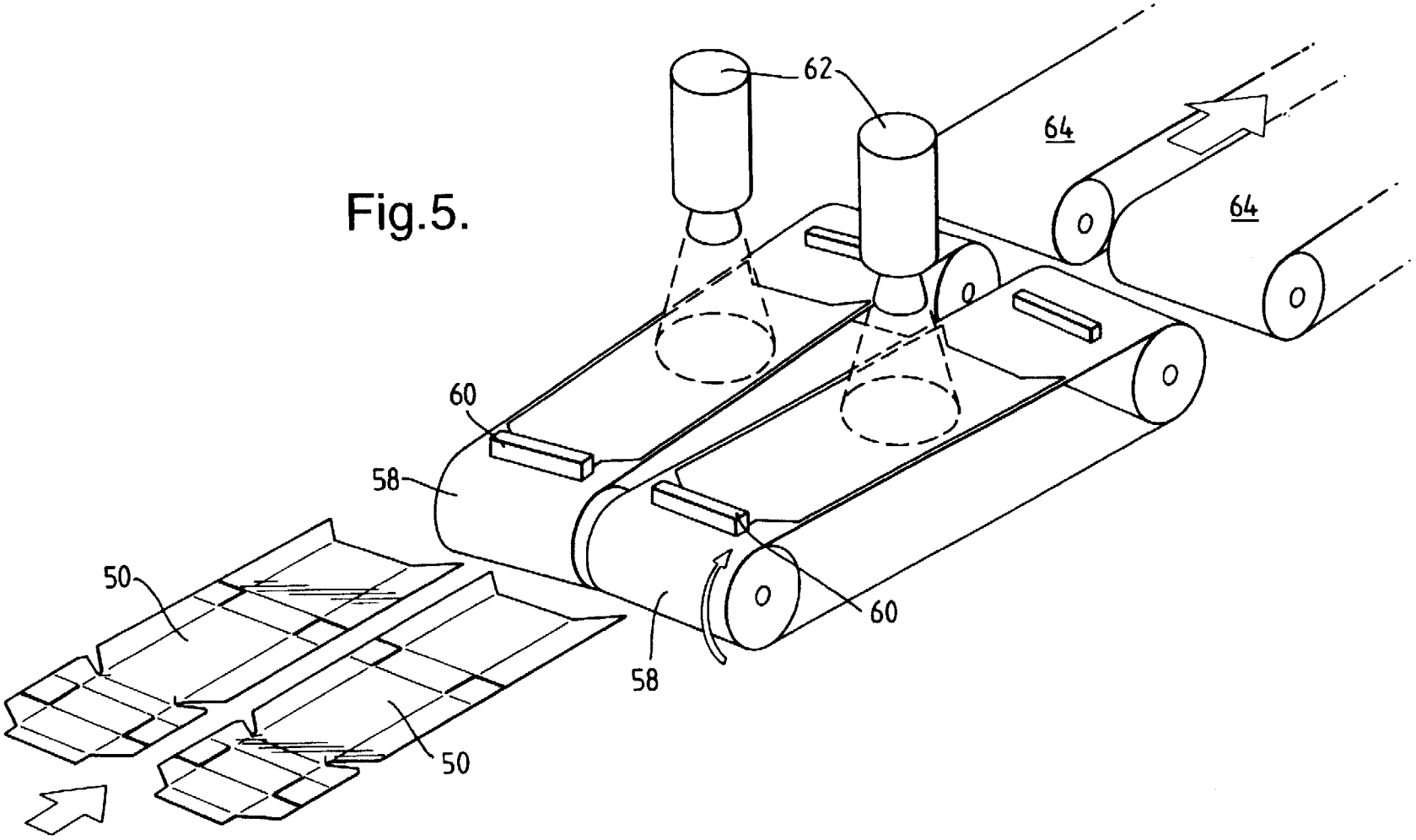
Figure 6:
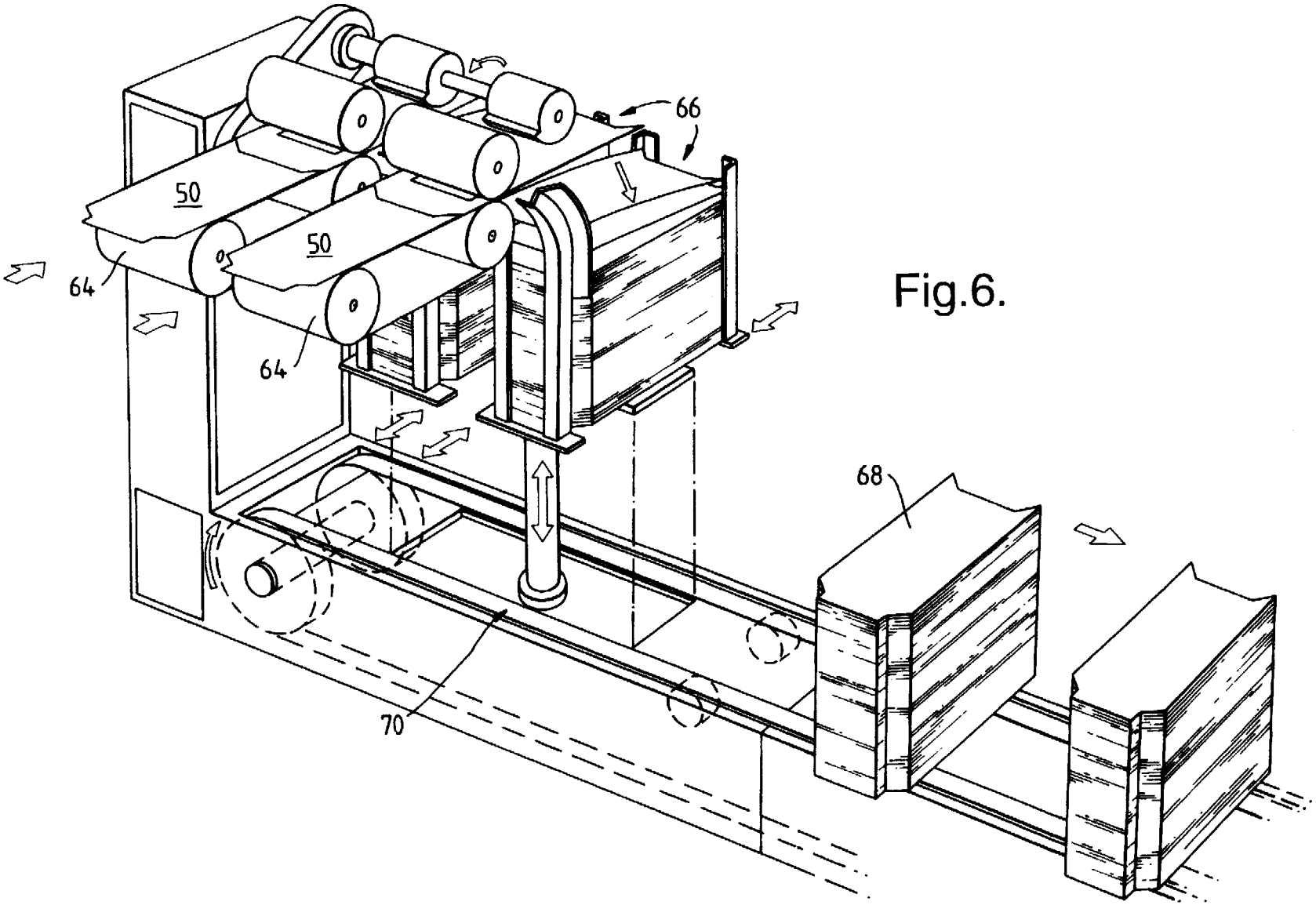
Figure 7:
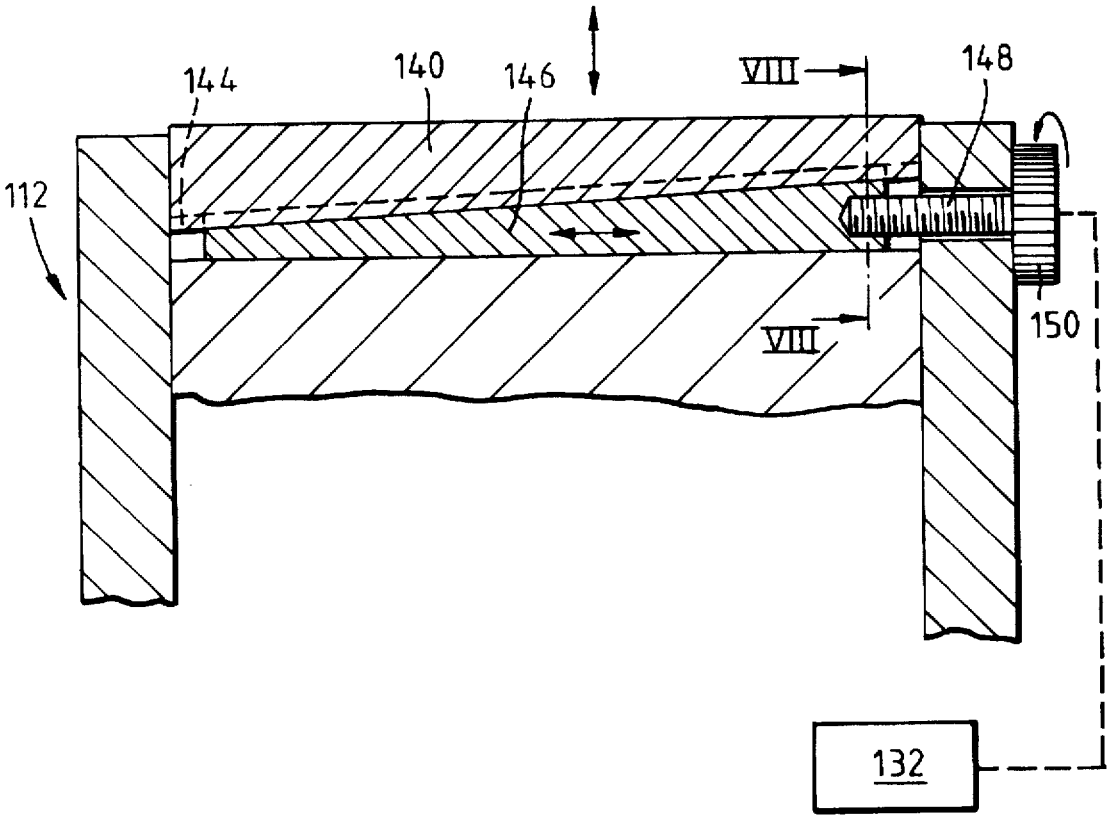
Figure 8:
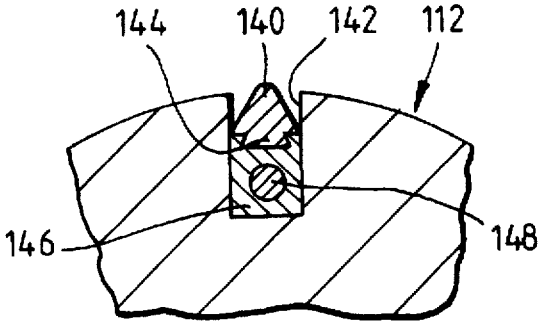

The invention will be further described, by way of example only, with reference to the accompanying diagrammatic drawings, in which:

FIG. 1 is a perspective view of a reel feed and mounting arrangement,

FIG. 2 is a perspective view of a first part of a delivery system for a web of packaging material delivered from a reel, FIG. 3 is a perspective view of a second part of the web delivery system, including means for severing the web into package blanks, FIGS. 3A–3F are plan views of the web and package blanks at various stages in the system of FIG. 3, FIG. 4 is a side view of a modified second part of the web delivery system, FIG. 5 is a perspective view of blank conveying conveyors downstream of the delivery system, FIG. 6 is a perspective view of a blank stacking arrangement, FIG. 7 is a longitudinal sectional view of part of a creasing roll, and FIG. 8 is a sectional view on the line VIII—VIII in FIG. 7.

The illustrated apparatus is capable of producing individual blanks for forming hinged lid packets (e.g. for cigarettes) from a web of preprinted paperboard material. Typically the apparatus is associated with and/or forms part of a packing machine.

As shown in FIG. 1, a web 2 of packaging material is supplied from a reel 4 carried on a spindle 6 extending from one arm of a rotatable pick up and transfer unit 8. The other arm of the unit 8 carries a similar spindle 10. The unit 8 is rotatable so as to interchange the positions of the spindles 6 and 10 thereby allowing successive replacement reels 12 received from a magazine 14 to be transferred to the operative position occupied by the reel 4. On expiry of the reel 4, and before rotation of the unit 8, the reel core is ejected to waste via a chute 16.

The magazine 14 receives reels 12 from a trolley or AGV (automatically guided vehicle) (not shown) and incorporates laterally-spaced inwardly-inclined traction belts 18 for advancing the reels towards the unit 8 so that successive leading replacement reels are loaded onto the spindle 10 (or 6). Means (not shown) is provided for detecting and feeding the end of the replacement reel 12 to a position from which it can be fed to an automatic splicing unit 20 prior to expiry of the old reel.

Typical approximate dimensions of the reels 12 are 1000 mm in overall diameter with a core diameter of 120 mm, and a width (corresponding to the width of the web 2) of 200 mm. This width of reel allows two parallel rows of longitudinally extending packet blanks on the web 2: other arrangements are possible, in particular a single row of blanks arranged with their longitudinal directions transverse to the width of the web.

The reel 4 is driven by a reel tracking roller 22 which contacts the outer circumference of the reel and which is carried on a movable arm 24. The roller 22 serves also to maintain lateral positioning of the reel 4 and web 2.

Beyond the splicing unit 20 the web 2 is received between driven nip rolls 26 and passed into a guide duct 28B, which, as shown in FIG. 2, has an initial upward part 28A, a horizontal part 288, and a final downward part 28C. The lengths of the parts 28A, 28B, and 28C are generally determined by the machine to which the present apparatus is linked or of which it forms a part and the location in which the apparatus is used. Thus a preferred arrangement would be for the magazine 14 to be located at a position convenient for reel handling, usually remote from the main part of the packing machine, and the duct part 28C to be located at the machine.

The upward part 28A of the duct may include a twist and incorporates guide rollers 30 for the web 2. Guide rollers such as the rollers 30 may be unnecessary for relatively short runs of the duct part 28A. Drive rollers 32 are located at each end of the horizontal part 28B, and also at the entrance and exit of a web buffer reservoir 34. Each of the rollers 32 may cooperate with a pressure roll 32A; a pivoted pressure roll (not shown) may be brought into engagement with the drive roll 32 at the upper end of the duct part 28A only during initial threading of the web. The web 2 may have sufficient inherent stiffness to be self-threading, i.e. so that a leading end of the web is capable of following the path of the duct 28 by means of the drive rolls provided without any additional intervention by an operator. Where the inherent stiffness of the web is insufficient, e.g. for particularly long runs, the web could be bowed slightly about a longitudinal axis to improve its ability to self-thread.

Drive of the web 2 into and out of the reservoir 34 is controlled so as to provide a variable length loop of web 2A in the reservoir and to allow continuous passage of the web downstream of the reservoir while allowing temporary stoppage of the upstream web during splicing.

Typical cross sectional dimensions of the duct 28 (for web of 200 mm width) are 250 mm by 15 mm. The duct need not be fully en closed as shown: it could comprise relatively adjustable late sections surrounding each side portion of the web.

As shown in FIG. 3, the web 2 passes from the end of the duct 28C to a main drive roll 36. The drive roll 36 and the subsequent parts of the web path may be incorporated in main structure of the packing machine. Cooperating with the roll 36 is a pressure roll 38 which is loaded against the roll 36 and which is carried by a pair of laterally spaced arms 40 which are pivotally mounted about the axis of roll 36. The angular position of the arms 40 and hence of the pressure roll 38 around the circumference of the roll 36 is controlled by means such as a servo motor (not shown): thus the roll 38 may be moved in a clockwise direction around the roll 36 so as to increase the wrap of the web 2 around the roll 38. The orientation of the web 2 at the rolls 36, 38 is such that passage of the web around the roll 38 tends to introduce a longitudinal curl into the web which is in an opposite sense to that which the web receives in the reels 12. The magnitude of this opposite curl introduced by the roll 38 increases with the angle of wrap of the web around the roll. As explained below, the position of roll 38 is controlled so as to minimise residual curl in the blanks produced from the web 2.

The web 2 passes from the roll 36 to an overprinting unit 42, capable of printing additional matter over the preprinted surface of the web. The unit 42 is optional, and may be omitted. Downstream of the unit 42 is a creasing roll 44 cooperating with an impression roll 46, and several pairs of rolls 48 for cutting and/or slotting the web 2 so as to produce blanks 50 (FIG. 3D) having the required configuration. FIGS. 3A–3D show various stages in processing of the web 2 as it passes from the roll 46 to the last cutting roll 48: FIG. 3A shows the web 2 with lines of creases 52, FIGS. 3B and 3C show intermediate stages in the cutting and slotting of the web, and FIG. 3D shows a pair of laterally spaced blanks 50 produced from the web. Material removed from the web 2 by the rolls 48 is collected and removed to waste by means of a suction unit 53. Generally, creasing operations precede cutting (i.e. shaping and/or severing) operations. Severing of the web 2 into separate blanks 50 is carried out in two stages, i.e. on separate rolls 48, so that the cut lines 49 (FIG. 3E) are made first followed by the line 51 (FIG. 3F). The position of the line 51 is biased so that it is spaced from the inner ends of the lines 49: in this way the lines 49 are generally prevented from intersecting the line 51, which would be detrimental to the appearance of the final packet (the lower edge defined by the line 51 being visible in the packet while the upper edge of the region 55 (FIG. 3F) is not). (The regions 57 are waste and are removed not later than the suction unit 53.) Although not so shown in FIG. 3 the longitudinal slitting of the web 2 may be carried out after removal of the waste material at the unit 53. It is preferable to keep the blanks longitudinally connected together, possibly by residual connections, for as long as possible, as an aid to conveyance and maintaining alignment.

The rolls 48 may be adjustable to adjust their effect on the web 2 or blanks 50, e.g. the pressure of the creasing rolls may be adjusted to vary the extent of the precreasing operation, in response to signals derived from means which monitors packing machine performance, particularly that associated with the blanks. For example if a fold or seal associated with a crease made by one of the rollers 48 is not being made properly, leading to rejected packets then adjustment of the appropriate roll may be made, e.g. to increase the pressure and hence better define the crease line. Such adjustment may thus be made automatically in response to wear of the creasing or shaping tool.

Synchronisation of the preprinted material on the web 2 with the operations of the overprinting unit 42 and of the rolls 44 and 48 is achieved by means of a print register detector 54, which detects the position of the print and generates a signal which is used to control the web drive if necessary. In a preferred drive arrangement, where the cut blanks are delivered directly to the packing machine, the rolls 44, 48 are directly driven from the main drive for the packing machine. Any necessary adjustment of the longitudinal position of the web during running can be achieved through corresponding adjustment of the main web drive by way of rolls 36, 38.

Downstream of the last cutting roll 48 a pair of accelerator rolls 56 is used to space the blanks 50 longitudinally apart. The rolls 56 could effect longitudinal separation of the blanks 50 in each stream from the remainder of the web 2, e.g. by breaking residual connections left in the cut line extending across the web. While leaving such connections in the line 51 may be considered undesirable for hinged lid packet blanks oriented longitudinally because of its effect on appearance of the packet, such connections would be more acceptable with other types or orientations of blanks.

Referring now to FIG. 5, each stream of blanks 50 is subsequently delivered onto an endless band conveyor 58 which is provided with spaced cleats 60 and which conveys successive blanks underneath an optical curl detector 62. If the detector 62 registers that the blank 50 is other than flat in the longitudinal direction a signal is delivered to the servo motor controlling position of the pressure roll 38 so as to increase or decrease the wrap of the web around the roll as appropriate.

The respective conveyors 58 diverge so as to space the blanks laterally apart prior to transfer to further endless band conveyors 64. As shown in FIG. 6, the conveyors 64 deliver the respective streams of blanks 50 to respective stacking units 66, each of which delivers stacks 68 of blanks to a common endless band conveyor 70 which delivers the stacks for further processing in the packing machine.

Where the packing machine is capable of operating continuously, blanks 50 may be fed directly into the machine, e.g. from the conveyors 64, without the need to stack the blanks. This arrangement allows higher speeds than are generally possible with arrangements involving an intermediate stacking process.

FIG. 4 shows a modified arrangement which may replace that shown in FIG. 3. The arrangement is associated with and may be regarded as forming part of a packing machine 200. The web 2 passes around an idler roll 100 at the exit end of a duct (not shown) or other path defining means for the web. Beyond the roll 100 the web 2 passes to a main drive roll 104 which cooperates with a pressure roll 106. A decurling roll 108, similar in function to the roll 38, is mounted on arms 110 pivoted about the axis of roll 104. The roll 108 carries laterally spaced flanges 109 for controlling tracking of the web 2.

The web 2 passes from the main drive roll 104 along a generally horizontal path between a series of rolls similar in function to the rolls 44, 48 and 56 but arranged slightly differently. A first roll 112 performs all creases on the web; a second roll 114 performs all cuts for shaping (e.g. tabs and mitres); a third roll 116 performs the final cross-cutting between successive blanks (i.e. equivalent to the cut 51 in FIG. 3F); and a fourth roll 118, which has a larger diameter than the other rolls, spaces successive blanks apart and carries a central circumferential knife 120 for making a longitudinal cut to separate side-by-side individual blanks delivered from the roll 116. Blanks are delivered from the rolls 118, 118A directly into the main part of the packing machine 200.

Each of the rolls 112, 114, 116 and 118 cooperates with an associated pressure roll 112A, 114A, 116A and 118A respectively. The roll 116A is provided with a suction manifold 122 so that cut-outs released from the web by the action of the final cut are conveyed by the roll to a suction waste pipe 124.

The position of the decurling roll 108 is controlled by a servo motor 126 linked to a microprocessor 128 which processes signals received from the sensors 62. The arrangement is such that if longitudinal curl in the blanks is detected the position of the roll 108 is moved in such direction as to tend to correct it. For example, if the upper surface of the blank is convex the arms 110 are moved anti-clockwise as viewed in FIG. 4 so as to increase the wrap around the relatively small diameter decurling roller 108.

The rolls 112, 114, 116 and 120 (and the corresponding pressure rolls) may be directly driven from a main drive for the packing machine. By selecting (or adjusting) the distances between the rolls, the phases in the drive cycle at which the various creasing and cutting operations occur may be arranged so that the load on the drive is optimised (usually so that the principal operations occur at different phase positions and not all together). The main drive roll 104 for the web 2 has an associated drive 130 which is synchronised with the packing machine (and hence with the rolls 112 etc.) by control signals passed from the microprocessor 128.

It is usual for a packing machine to have one or more detectors for determining whether a pack has been correctly made. For example, as shown in FIG. 4, the packing machine 200 may include an optical sensor 202 for detecting whether a flap has been successfully folded and sealed. An unacceptably high failure rate may indicate that the crease made in the blank associated with folding of the particular flap has not been made sufficiently strongly. Adjustment of the creasing pressure, and hence the strength of the creases, can be made by increasing or decreasing the pressure between the rolls 112 and 112A, and this may be all that is required, where all creases need strengthening.

It is known that for maximum efficiency in operation of machines for packing articles in hinged lid packets that certain creases are preferably made more strongly than others. The direction of the grain in the material of the blank has an effect on required creasing strength: normally with reel-fed material the grain runs longitudinally, so that the material tends to fold more easily about a longitudinal axis. Referring to the blanks shown in FIG. 3A, for example, the transverse and longitudinal creases need different creasing strengths, and in the roll 112 this is provided by slightly different heights of creasing members. In use, these may wear at different rates so that adjustment of overall pressure between the roll 112 and 112A can only partially compensate. The roll 112 therefore provides for individual adjustment of creasing members, to compensate for wear and/or to respond to detection in the packing machine of failure of an associated pack making operation.

FIGS. 7 and 8 are part-sectional views of the roll 112 showing a polyurethane or rubber creasing member 140 protruding from a longitudinally-extending slot 142. The member 140 has an inner face which is tapered in a longitudinal direction and carries a key 144 engaged with a keyway in a correspondingly tapered face of a wedge-shaped block 146 housed in the slot 142. At one end the block 146 is connected to a threaded shaft 148 engaged with an operating wheel 150. The arrangement is such that rotation of the wheel 150 causes the block 146 to move in a direction parallel to the axis of the roll 112 thereby causing the member 140 to be moved in a radial direction so as to protrude more (or less) above the general surface level of the roll.

The wheel 150 may be a thumb-wheel, operated manually for adjustment. Alternatively, the wheel 150 may comprise a gearwheel or the like driven by a servo motor 132. In the latter case, and referring also to FIG. 4, the servo motor 132 is linked to the microprocessor 128, so as to respond to signals derived from the packing machine. Thus, if a particular flap is not folding or sealing properly the servo motor 132 may adjust the member 140 so that it protrudes more from the roll 112 and therefore increases the depth of the corresponding crease in the blank. As shown in FIG. 4, the roll 112 may have several members corresponding to the member 140 independently controlled by servo motors 132.

The member 140 could be of metal and cooperate with a polyurethane or rubber surface or insert on the roll 112A. The surface or insert could constitute the operating member: in other words the surface against which the member 140 acts could be moved radially, e.g. in response to signals from the packing machine, instead of or as well as the member 140.

In addition to the central slitting knife 118 the roll 120 may carry waste edge trimming slitters (not shown). In this case adjustable tracking control is preferably provided, typically in the region just upstream of the main drive roll 104. The tracking control may respond to a detector (not shown), e.g. responding to position of a centre line of the web. By providing a web having excess width with the edges being subsequently trimmed, faulty or damaged blanks due to damage caused to the reel during handling may be avoided.

We claim:

1. A packing method including the steps of feeding a web of card-like packaging material suitable for forming blanks for hinged lid packets for cigarettes; performing at least one creasing or shaping operation on the web substantially at or adjacent to a packing location, including passing the web between at least one pair of creasing rolls to define at least one crease in each blank which is to be severed from the web, said crease extending along a line about which the blank is to be folded; severing individual packaging blanks from the web; and delivering the blanks individually from said severing operation for folding around a group of cigarettes to be packed at said packing location, including folding each blank about said line in the formation of a hinged lid packet from said blank and containing said group of cigarettes.

2. A method as claimed in claim 1, including the steps of unwinding the web from a reel and performing substantially all creasing and/or shaping operations required to produce individual blanks after the web has been unwound from the reel.

3. A method as claimed in claim 1, including the step of moving the packaging material continuously during the creasing and/or shaping operation or operations.

4. A method as claimed in claim 2, wherein the blanks are substantially rectangular and are arranged with their longitudinal axes parallel to the length of the web.

5. A method as claimed in claim 4, wherein two or more blanks are arranged across the width of the web.

6. A method as claimed in claim 1, including the steps of correcting curl in the web upstream of said creasing or shaping operation.

7. A packing method as claimed in claim 1, including the steps of monitoring the production of hinged lid packets from said blanks, including determining the effectiveness of folding said blanks about said line, and adjusting said creasing rolls in accordance with signals derived from said monitoring step.

8. Packing apparatus including means for feeding a web of packaging material; operating means for performing at least one creasing or shaping operation on the web; severing means for severing packaging blanks from the web; delivery means for delivering said blanks for wrapping or folding around articles to be packed; means for detecting curl in the blanks after they have been severed from the web; and means for correcting curl in the web upstream of said operating means and in accordance with signals derived from said detecting means.

9. Apparatus as claimed in claim 8, wherein the feeding means includes reel unwinding means and web conveying means extending between said unwinding means and said operating means.

10. Apparatus as claimed in claim 1, wherein said operating means comprises at least one pair of operating rolls between which the web passes, at least one of said rolls carrying an operating member.

11. Apparatus as claimed in claim 10, wherein the position of said operating member is adjustable to alter the position at which and/or the extent to which the member influences the web.

12. Apparatus as claimed in claim 11, including means for packing articles in said blanks, means for monitoring at least one wrapping or folding operation, and means for adjusting said operating means in response to signals derived from said monitoring means.

13. Apparatus as claimed in claim 10, wherein said operating means comprises two or more pairs of rolls arranged in series to act on the web.

14. Apparatus as claimed in claim 13, wherein an upstream pair of rolls performs at least one creasing operation on the web and a downstream pair of rolls performs at least one cutting operation on the web.

15. Apparatus as claimed in claim 8, wherein said curl correcting means comprises means defining a curved path for the web arranged to introduce curl into the web in a sense opposite to that which is detected by the detecting means.

16. Apparatus as claimed in claim 15, wherein the curl correcting means includes means for varying the angle of wrap of the web around the curved path defining means.

17. Apparatus as claimed in claim 15, wherein the curved path defining means includes a pivoted roll.

18. Packing apparatus including means for feeding a web of packaging material from a reel; means for severing packaging blanks from the web; means for wrapping or folding the blanks around articles to be packed; means for correcting curl in the web or blanks upstream of said wrapping or folding means; means for detecting curl in the blanks after they have been severed from the web; and means for correcting curl in the web upstream of said operating means and in accordance with signals derived from said detecting means.

19. Packing apparatus including means for feeding packaging material in web form; means for performing at least one creasing operation on the material, including at least one pair of creasing rolls carrying at least one peripheral creasing member for making a crease defining a fold line in the web; means for severing packaging blanks from the web; means for folding a blank around at least one article to be packed, including means for monitoring the performance of the folding operation to determine whether the blank has been successfully folded about said fold line; and means for adjusting the creasing operation accordingly to optimize said folding performance, including means for adjusting the position of said peripheral creasing member in accordance with signals derived from said monitoring means.

* * * * *